United States Patent [19]

Fingerle et al.

[11] Patent Number: 4,840,154

[45] Date of Patent: Jun. 20, 1989

[54] TUBULAR CERAMIC BODY FOR GAS PASSAGES IN CYLINDER HEAD OF INTERNAL COMBUSTION ENGINE

[75] Inventors: Dieter Fingerle, Hochdorf; Wolf-Dieter Gundel, Pliezhausen-Ruebgarten, both of Fed. Rep. of Germany

[73] Assignee: Feldmühle Aktiengesellschaft, Duesseldorf, Fed. Rep. of Germany

[21] Appl. No.: 153,132

[22] Filed: Feb. 8, 1988

[30] Foreign Application Priority Data

Feb. 26, 1987 [DE] Fed. Rep. of Germany ..... 3706208

[51] Int. Cl.[4] ..... F01N 7/14; F01N 7/16; F01N 7/18

[52] U.S. Cl. ..... 123/193 H; 60/282; 138/145

[58] Field of Search ..... 123/41.82 A, 668, 193 H, 123/188 M; 60/272, 282; 138/145, 149

[56] References Cited

U.S. PATENT DOCUMENTS

| | | | |
|---|---|---|---|
| 4,346,556 | 8/1982 | Rice et al. | 123/193 H |
| 4,508,066 | 4/1985 | Hartsock | 123/193 H |
| 4,715,178 | 12/1987 | Tsukuda et al. | 123/193 H |
| 4,781,157 | 11/1988 | Wade et al. | 123/193 H |

FOREIGN PATENT DOCUMENTS

| | | | |
|---|---|---|---|
| 3346394 | 9/1986 | Fed. Rep. of Germany . | |
| 251502 | 10/1947 | France | 123/193 H |
| 0087838 | 7/1980 | Japan | 123/193 H |
| 0190537 | 11/1983 | Japan | 123/193 |

*Primary Examiner*—David A. Okonsky
*Attorney, Agent, or Firm*—Michael J. Striker

[57] ABSTRACT

A tubular ceramic body for gas passages in a cylinder head of an internal combustion engine comprises a tubular piece having an opening, two separate tubular portions each having an end side and provided with an opening at the end side, the tubular portions merging into the tubular piece in a transition region, and a connection provided between the tubular portions at least in the transition region of the tubular portions into the tubular piece, the ceramic body being formed as a one-piece member produced in a single sintering process from a single material, and the connection of the tubular portions being formed by a common wall.

7 Claims, 5 Drawing Sheets

Fig. 1
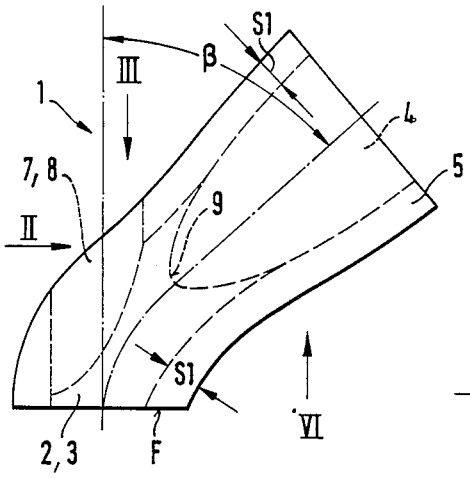
Fig. 2
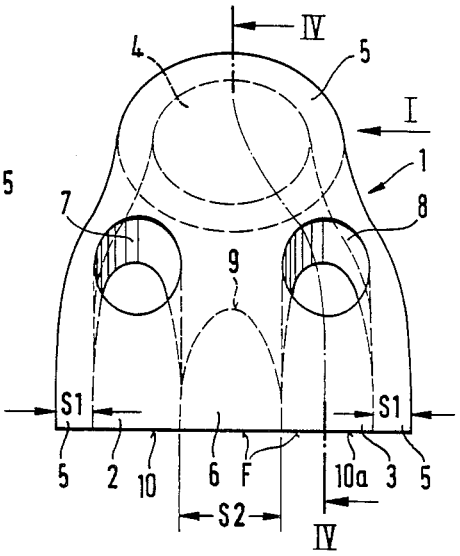
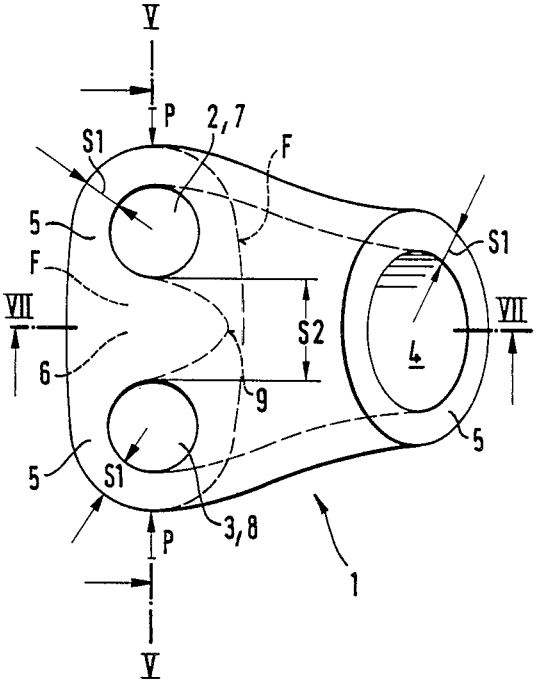
Fig. 3

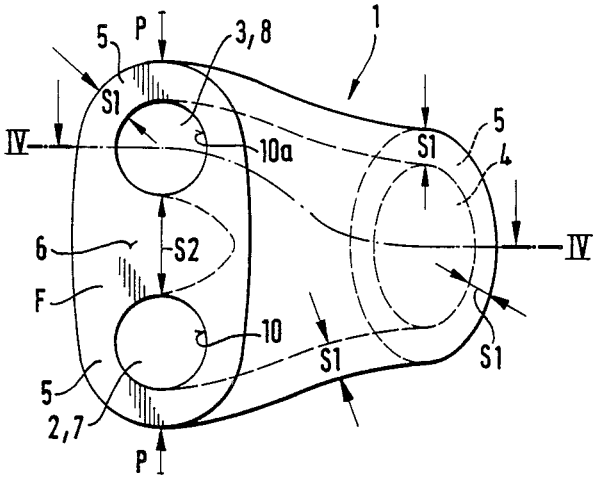
Fig. 6
Fig. 4
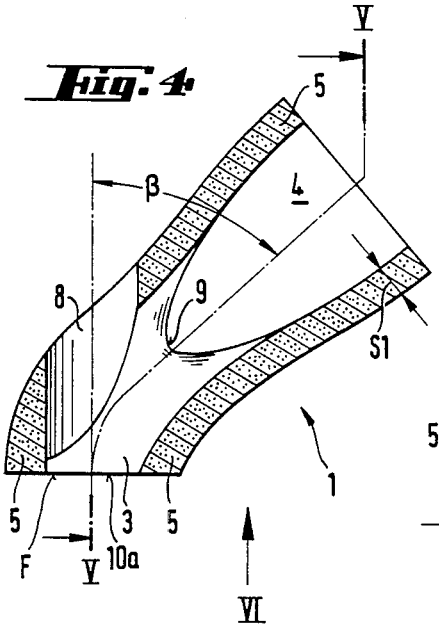
Fig. 5
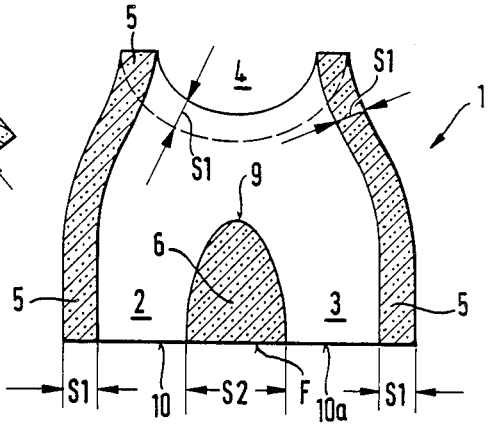

TUBULAR CERAMIC BODY FOR GAS PASSAGES IN CYLINDER HEAD OF INTERNAL COMBUSTION ENGINE

BACKGROUND OF THE INVENTION

The present invention relates to a tubular ceramic body for gas passages of a cylinder head in an internal combustion engine.

Tubular ceramic bodies of the above-mentioned general type are known in the art. One of such bodies is disclosed in the German Patent No. 3,346,394. The ceramic body disclosed in this reference has a bifurcated shape. For supporting both tubular portions of the body, a connection is provided, which must counteract the pressures occurring during casting of the ceramic body in the cylinder head with a sufficient resistance. The connection must be composed of zirconium oxide applied by plasma spraying, while the ceramic tube must be composed of tialite (aluminum titanate).

The above-described ceramic body possesses the disadvantage in that for its manufacture it is necessary to form the ceramic pipe and connect different materials having significantly different thermal expansion coefficients and moduli of elasticity. Thereby during application of temperature, first of all during cast and also during the operation, different thermally induced stresses are produced in the ceramic body which includes elements composed of different materials. Therefore there is a danger that cracks can occur in the ceramic body, especially at the contact surfaces of both materials. Further disadvantages are stress peaks which can be expected in the ceramics and also in the casting material. They occur during cooling of the melt in connection with the significantly different deformation properties of different materials (modulus of elasticity). The use of a single material for bringing the connection on the finally sintered tubular body during a second heating step would lead only to a limited result. The reason is that because of different shrinkage of the sintered pipe and a connection which has to be sintered, cracks can occur in the body. A further disadvantage is that only a low connecting strength is produced between the connection and the tubular body itself. In the connection applied by plasma spraying, even in the event of the use of a same raw material, a different joint structure is produced between the ceramic body which is made by slip casting and subsequent sintering, and the connection formed by plasma spraying. Thereby the above specified disadvantages are caused. It has also been shown that especially inner sides of the tubular portions, or the positions at which a support must be provided by means of the connection, are especially endangered during casting of the ceramic body into metal alloys.

SUMMARY OF THE INVENTION

Accordingly, it is an object of the present invention to provide a tubular ceramic body of the above-mentioned type which avoids the disadvantages of the prior art.

More paticularly, it is an object of the present invention to provide a tubular ceramic body with two separate tubular portions merging into one tubular piece which counteracts the pressure forces occurring during casting of a metal melt, especially between the tubular portions, with increased resistance.

In keeping with these objects and with others which will become apparent hereinafter, one feature of the present invention resides, briefly stated, in a tubular ceramic body which is formed as a one-piece member of a single material made by molding, and sintering in a single sintering process and the connection of the tubular portions with one another is formed by a common wall.

The term "one-piece" means that the ceramic body, including the ceramic portion provided between the individual tubular portions, has a unitary and homogenous structure from a same initial material composition, has a substantially same density and porosity, and produced by molding from a slip casting mass and in a single sintering process.

When the tubular ceramic body is formed in accordance with the present invention, only one sintering process is required because of the one-piece structure of the ceramic body from the same material. The disadvantage of a low connection strength between the individual tubular portions and between the connection in the prior art are eliminated as well as the disadvantage of a low structural strength of a ceramic pipe with tubular portions with generally constant wall thicknesses.

The decisive advantage of the inventive tubular ceramic pipe is that the ceramic body because of its one-piece formation, has throughout the property spectrum. In other words, in all points of the ceramic body approximately identical thermal expansion coefficients and approximately identical moduli of elasticity are provided. Therefore no different stress conditions, either in the ceramic body itself, or in metal casting which envelopes the ceramic body, can take place.

In accordance with an especially advantageous embodiment of the invention, the ceramic pipe is composed of aluminum titanate. Despite the fact that this material has a considerably lower strength as compared with other ceramic materials, for example, zirconium oxide, it is already proposed for forming tubular ceramic bodies in waste gas conduits, since it has low thermal expansion coefficients and a special thermal isolating property. In the past there were always difficulties since especially during casting with metals, and especially during casting with ferrous metals, a damage to the ceramic pipe occurred.

When the shape and size of the ceramic pipe are significantly determined by the construction of the ceramic head, in accordance with a preferable embodiment of the invention a wall thickness of the common wall is considered as suitable when it lies between 0.8 and 6 cm, preferably between 1 and 2 cm, as measured on an imaginary line between both center points of the inlet openings of the tubular portions.

The uniform structure of the common wall lying between both tubular portions, as a result of the one-piece construction, can take over in a pronounced manner a supporting function during action of lateral pressure forces on the outer walls of the tubular portions. In accordance with an especially advantageous embodiment of the invention, the thickness of the outer wall and the thickness of the joint wall between both tubular portions are selected so as to correspond to a ratio of between 1:2.5 and 1:5.

In accordance with a further embodiment of the invention, the valve-side closing surface which lies in the region o the inlet openings of both tubular portions is oval. Thereby the occurrence of stress peaks in metal and in the ceramic because of the homogenous transition from thick to thin points is avoided. Also, no material accumulation takes place in casting, so that during cooling no local differently cooled zones are produced.

When the construction of the cylinder head requires so, in accordance with a further embodiment of the invention the closing surface can have the shape of a numeral 8. It is advantageous when the thickness of the web measured perpendicularly to an imaginary line extending between the center point of the inlet openings of both tubular portions, corresponds in its narrowest point approximately to the half inner diameter of the inlet openings of both tubular portions.

In any case the outer contours of the individual portions of the ceramic pipe harmoniously merge into one another. Openings for assembling of valve guides may be provided during the production of the sintered body, or, alternatively may be applied after the casting of the tubular ceramic body into metal alloys.

In accordance with the present invention, the tubular ceramic body can be formed as a so-called bifurcated pipe, so that the common wall of both tubular portions has a wall thickness which decreases in direction to the transition region of the tubular portions into the tubular piece. It is also possible in accordance with another embodiment that the tubular portions extend parallel to one another and the common wall has an approximately constant wall thickness. The last-mentioned shape can be used when the outlet valves are arranged in a cylinder near one another. The first mentioned shape can be used when the outlet valves are arranged one behind the other, as considered in direction of the motor block.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a bifurcated ceramic body in accordance with the present invention, as seen from one side;

FIG. 2 is a front view of the ceramic body in direction of the arrow II in FIG. 1;

FIG. 3 is a plan view of the ceramic body in direction of the arrow III in FIG. 1;

FIG. 4 is a view showing a longitudinal section along the line IV—IV in FIG. 2, which shows on the one hand, an inlet opening together with an associated opening for a valve guide, as well as the outlet opening;

FIG. 5 is a view showing a longitudinal section through the whole tubular piece, in which a waste gas stream enters, together with the tubular piece which has the outlet opening, in correspondence with the line V—V in FIG. 4, with the whole ceramic pipe in section;

FIG. 6 is a partial view in direction VI of the ceramic pipe of FIG. 1 or FIG. 4;

DESCRIPTION OF THE PREFERRED EMBODIMENTS

Figure 7:
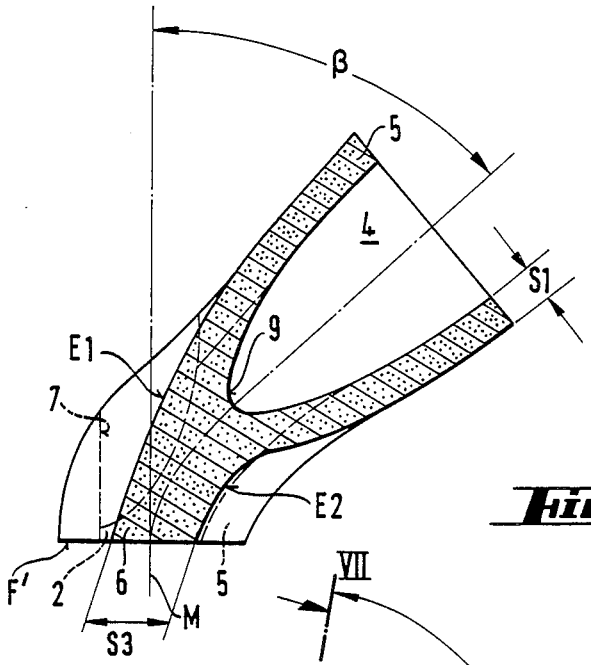
FIG. 7 is a plain vertical section along the plane VII—VII in FIG. 8, showing two sections respectively above and below the common wall between both tubular portions in accordance with a further embodiment.

A ceramic body for gas passages in a cylinder had of an internal combustion engine in accordance with the present invention is identified with reference numeral 1. The ceramic body shown in FIGS. 1–6 includes two tubular portions 2 and 3 and a tubular piece 4. The tubular portions 2 and 3 form the shape of a fork and narrow in a transition region 9 toward the tubular piece 4. Openings 7 and 8 are arranged in alignment with both tubular portions 2 and 3 and used for application of valve guides.

The tubular portions 2 and 3 of the ceramic pipe extend with a predetermined angle $\beta$ which is determined by the shape of the cylinder head. This can be seen specifically from FIG. 4 of the drawing.

The tubular portions 2 and 3 have outer walls 5 which have the same thickness S1. The tubular piece 4 is also formed with the same wall thickness S1. A common wall 6 is arranged between both tubular portions 2 and 3. In the region of inlet openings 10 and **10*a* of the tubular portions 2 and 3, the common wall 6 reaches its maximum wall thickness S2. Pressure forces which occur during casting are identified in FIG. 6** with the arrow P.

The region which surrounds the inlet openings 10 and **10*a* forms the valve-side closing surface F. The closing surface F has an oval shape as can be seen more specifically in FIG. 6**.

Figure 8:
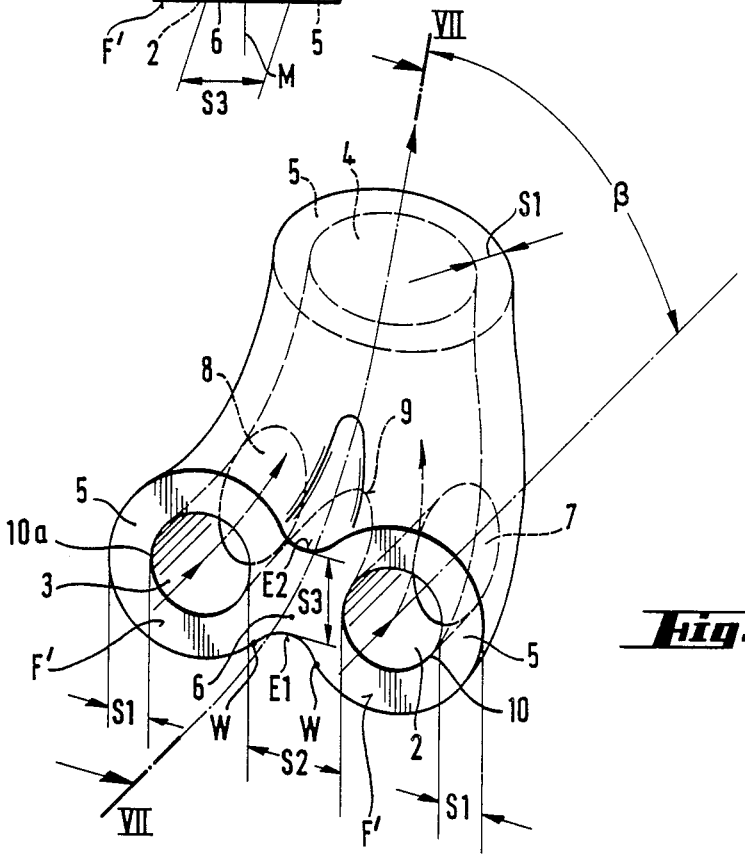
FIG. 8 is a perspective view of the ceramic pipe of FIG. 7, as seen in an inclined fashion from below and from one side.

The ceramic body shown in FIGS. 7 and 8 substantially corresponds to the ceramic body of FIGS. 1–6. However, depressions E1 and E2 are formed between the inlet openings 10 and **10*a* of the tubular portions 2 and 3. Thereby, the outer wall 5 of the tubular portions 2 and 3 is formed as the numeral 8 and the valve-side closing surface F′ also has the shape of the numeral 8**.

In the ceramic body of FIGS. 7–8, the transition of the outer wall 5 of the tubular portions 2 and 3 into the common wall 6 occurs on their outer contours in the reversing point of the contours identified as W.

A web is formed between the depressions El and E2. It has a web thickness S3 which approximately corresponds to the half value of the inner diameter of the inlet openings 10 and **10*a***.

Figure 10:
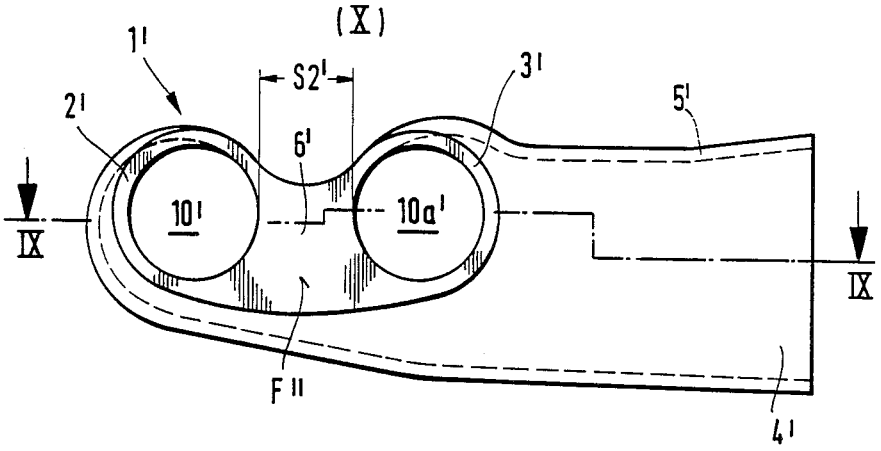
FIG. 10 is a bottom view in direction of the arrow X in FIG. 9.
Figure 9:
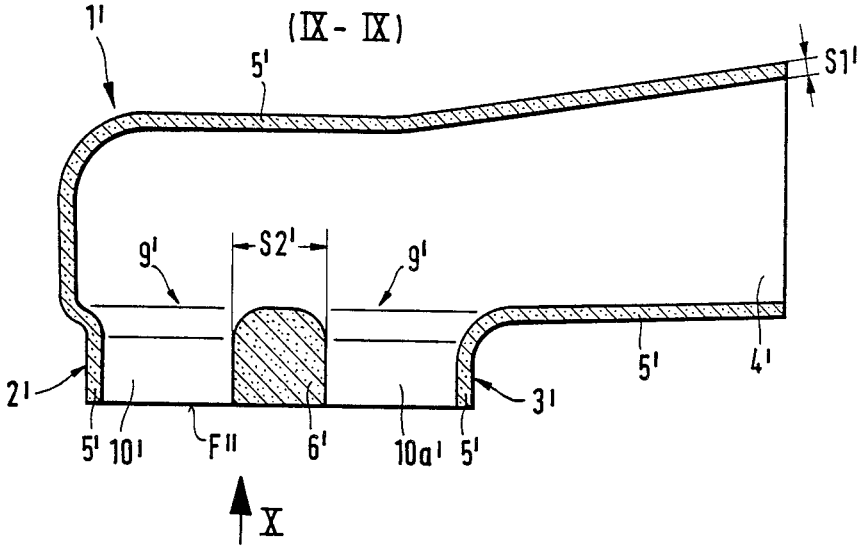
FIG. 9 is a view showing a ceramic body with tubular portions which extend parallel to one another, in a longitudinal section.

A tubular ceramic body 1′ in accordance with a different embodiment is shown in FIGS. 9 and 10. It has parallel tubular portions 2′ and 3′ which merge in a peripheral region 9′ into a tubular piece 4′ The tubular portions 2′ and 3′ are connected with one another by a common wall ′ which has a wall thickness S2′ The wall 6′ has a constant wall thickness from the region of the inlet openings 10′ and **10*a*′ to the transition region 9′. The outer walls 5′ of the tubular portions 2′ and 3′ and the tubular piece 4′ have a constant wall thickness S1′**. The valve-side closing surface F″ is in this embodiment kidney-shaped.

Figure 11:
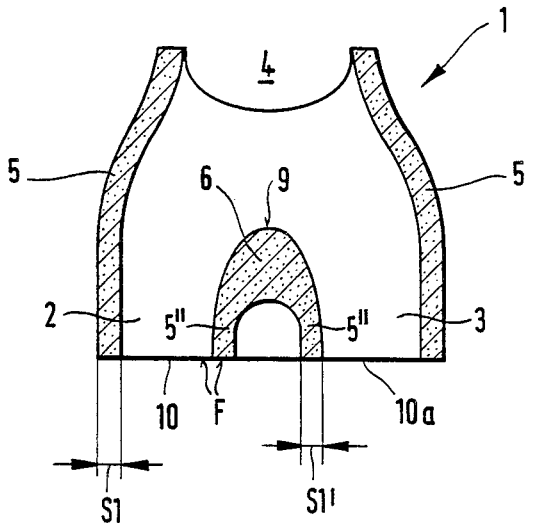
FIG. 11 is a longitudinal section through the whole tubular piece in accordance with a further embodiment of the invention.

FIG. 11 shows a further embodiment of a ceramic body 1. It substantially corresponds to the ceramic body of of the embodiments of FIGS. 1–7. The difference in this embodiment is that the common wall 6 in the region of the inlet openings 10 and 10*a* is not throughgoing. In this region the tubular portions 2 and 3 have also inner walls 5″ which are formed with a thickness S1″ corresponding to the wall thickness S′ of the outer wall 5. Both tubular portions 2 and 3 have no common wall in the region of the inlet openings 10 and 10*a*. Instead, they are formed here with a wall thickness S1″ which correspond to the wall thickness S1 of the outer wall 5. The inner walls 5″ run in direction to the mouth region 9 into the common wall 6 first with an increasing wall thickness and then in direction to the transition region 9 with a decreasing wall thickness.

It will be understood that each of the elements described above, or two or more together, may also find a useful application in other type of constructions differing from the types described above.

While the invention has been illustrated and described as embodied in a tubular ceramic body for gas passages in cylinder head of an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A tubular ceramic body for gas passages in a cylinder head of an internal combustion engine, comprising a tubular piece having an opening; two separate tubular portions each having an end side and provided with an opening at said end side, said tubular portions merging into said tubular piece in a transition region; and a connection provided between said tubular portions at least in said transition region of said tubular portions into said tubular piece, said ceramic body being formed as a one-piece member produced in a single sintering process from a single material, and said connection of said tubular portions being formed by a common wall.

2. A tubular ceramic body as defined in claim 1, wherein said ceramic body is composed of aluminum titanite.

3. A tubular ceramic body as defined in claim 1, wherein said tubular bodies in said end region in which said openings are provided form a flat valve-side closing surface.

4. A tubular ceramic body as defined in claim 3, wherein said valve-side closing surface has an oval shape.

5. A tubular ceramic body as defined in claim 3, wherein said valve-side closing surface has the shape of numeral eight.

6. A tubular ceramic body as defined in claim 1, wherein said common wall has a wall thickness which decreases towards said transition region.

7. A tubular ceramic body as defined in claim 1, wherein said common wall has a constant wall thickness in direction towards said transition region.

* * * * *